US005919101A

United States Patent [19]

Yokota et al.

[11] Patent Number: 5,919,101

[45] Date of Patent: Jul. 6, 1999

[54] SOLID GOLF BALL

[75] Inventors: Masatoshi Yokota; Keiji Moriyama, both of Shirakawa; Satoshi Iwami, Himeji, all of Japan

[73] Assignee: Sumitomo Rubber Industries, Ltd., Hyogo, Japan

[21] Appl. No.: 09/029,227

[22] PCT Filed: Aug. 23, 1996

[86] PCT No.: PCT/JP96/02354

§ 371 Date: Feb. 25, 1998

§ 102(e) Date: Feb. 25, 1998

[87] PCT Pub. No.: WO97/07861

PCT Pub. Date: Mar. 6, 1997

[30] Foreign Application Priority Data

Aug. 25, 1995 [JP] Japan ..... 6-217292
May 17, 1996 [JP] Japan ..... 6-123209

[51] Int. Cl.[6] ..... A63B 37/12; A63B 37/06

[52] U.S. Cl. ..... 473/374; 473/373; 473/377; 473/378

[58] Field of Search ..... 473/373, 374, 473/377, 378

[56] References Cited

U.S. PATENT DOCUMENTS 4,556,220 12/1985 Tominaga et al. .
5,253,871 10/1993 Voillaz .
5,490,674 2/1996 Hamada et al. .
5,702,311 12/1997 Higuchi et al. ..... 473/374 X
5,820,486 10/1998 Tanaka et al. ..... 473/374

FOREIGN PATENT DOCUMENTS 2278609 12/1994 United Kingdom .

*Primary Examiner*—George J. Marlo
*Attorney, Agent, or Firm*—Birch, Stewart, Kolasch & Birch, LLP

[57] ABSTRACT

The present invention provides a golf ball, particularly a solid golf ball having good shot feel and excellent controllability at approach shot, while keeping the characteristics inherent to the solid golf ball, i.e. excellent flight performance and excellent durability. The present invention relates to a solid golf ball comprising a core and a cover formed on the core, wherein the cover has a two-layer structure consisting of an inner cover and an outer cover formed on the inner cover, and the core is formed from a rubber composition comprising 0.05 to 5 parts by weight of an organic sulfide compound, based on 100 parts by weight of a base rubber.

3 Claims, 1 Drawing Sheet

SOLID GOLF BALL

This application is the national phase under 35 U.S.C. §371 of prior PCT International Application No. PCT/JP96/02354 which has an International filing date of Aug. 23, 1996 which designated the United States of America, the entire contents of which are hereby incorporated by reference.

FIELD OF THE INVENTION

The present invention relates to a solid golf ball. More particularly, it relates to a solid golf ball having good shot feel and excellent controllability at approach shot, while keeping the characteristics inherent to the solid golf ball, i.e. excellent flight performance and excellent durability.

BACKGROUND OF THE INVENTION

Hitherto, there have been mainly produced two types of golf balls. The one is a solid golf ball, such as a two-piece golf ball, which is composed of a core formed from integrally molded rubber material and a thermoplastic resin cover (e.g. ionomer resin cover) formed on the core. The other is a thread wound golf ball which is composed of a solid or liquid center, a thread rubber layer formed by winding thread rubber around the center and a cover of ionomer resin or balata etc. having a thickness of 1 to 2 mm, covering on the thread rubber wound layer. The solid golf ball, when compared with the thread wound golf ball, has better durability and better flight performance because of larger initial velocity when hitting and longer flight distance. On the other hand, the solid golf ball exhibits hard shot feel when hitting, and shows difficulty to put spin on the ball, thus poor controllability at approach shot. The difficulty of putting spin on the ball comes from the structural features of the solid golf ball that an initial velocity is very high, when hitting, and a contact area of the ball with a hitting face of a golf club is very small.

In order to solve the problem, the cover is made from softer material to make the outer portion of the golf ball soft. However, the rebound characteristics of the golf ball are less than those of conventional cover and deteriorate flight distance inherent to the two-piece solid golf ball.

In order to solve the above problem, it is proposed that the cover is made two-layered, of which each layer is formed from a different material. For example, Japanese Patent Kokai Publication No. 244174/1992 proposes that a thermoplastic material comprising a block copolymer of amides is used in the inner cover layer and a thermoplastic resin is used in the outer cover layer. However, the resulting golf ball has poor rebound characteristics and reduces flight distance, because the block copolymer of amides has low rigidity and is used in the inner portion of the cover. Japanese Patent Kokai Publication No. 343718/1994 proposes the use of a hard high-acid content ionomer resin in an inner cover of a two-layer structured cover golf ball to increase the fight distance. The hard high acid content ionomer resin, which has high rigidity, is used in the inner cover, but the resulting golf ball has not hardness sufficient to increase a golf ball velocity because of softening the outer cover layer. It is required to make the inner cover layer harder to increase the ball velocity.

DETAILED DESCRIPTION OF THE INVENTION

Figure 1:
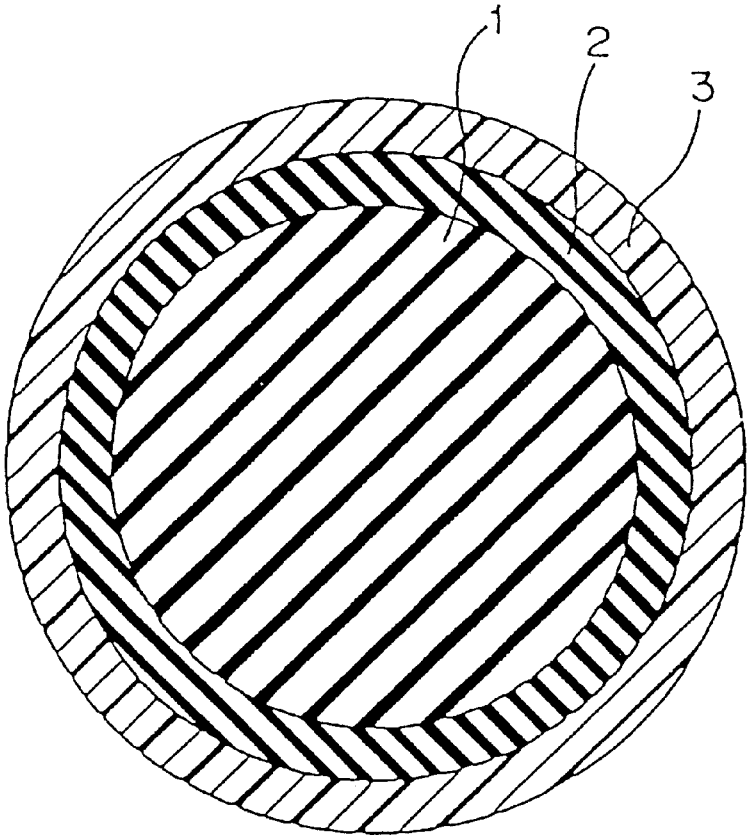
FIG. 1 is a schematic cross section illustrating one embodiment of the golf ball of the present invention.

In order to solve the above problem, the present inventors have intensively studied and have found that rebound characteristics of a core are improved by forming a core from a rubber composition comprising 0.05 to 5 parts by weight of an organic sulfide compound, based on 100 parts by weight of a base rubber, thereby improving the rebound characteristics of the resulting golf ball.

The present invention will be described in detail hereinafter. In the golf ball of the present invention, a two-layer structured cover layer 2 and 3 is formed on a core 1. The core is obtained by vulcanizing or press-molding a rubber composition. The rubber composition comprises a base rubber, a crosslinking agent, a co-crosslinking agent, an organic sulfide compound and the like.

The base rubber may be natural rubber and/or synthetic rubber which has been conventionally used for solid golf balls. Preferred is cis-1,4-polybutadiene rubber containing a cis-1,4 bond of not less than 40%. The polybutadiene rubber may be mixed with natural rubber, polyisoprene rubber, styrene-butadiene rubber, EPDM, and the like.

The crosslinking agents may be an organic peroxide such as dicumyl peroxide, t-butyl peroxide and the like. Preferred organic peroxide is dicumyl peroxide. An amount of the organic peroxide is from 0.3 to 5.0 parts by weight, preferably from 0.5 to 3.0 parts by weight, based on 100 parts by weight of the base rubber.

The co-crosslinking agent may be a material which has been conventionally used for solid golf balls. It includes a metal salt of unsaturated fatty acid, particularly mono or divalent metal salts of unsaturated fatty acids having 3 to 8 carbon atoms (e.g. acrylic acid, methacrylic acid, etc.). Preferred is zinc acrylate because it imparts high rebound characteristics to the resulting golf ball. An amount of the co-crosslinking agent is preferably 10 to 40 parts by weight, based on 100 parts by weight of the base rubber. When the amount of the co-crosslinking agent is larger than 40 parts by weight, the core is too hard and thus shot feel is poor. On the other hand, when the amount of the co-crosslinking agent is smaller than 10 parts by weight, rebound characteristics are degraded.

It is required that the rubber composition used for making the solid golf ball of the present invention comprises an organic sulfide compound, in addition to the above components. Examples of the organic sulfide compound include polysulfides having 2 to 4 sulfur atoms, such as diphenyl polysulfide, dibenzyl polysulfide, dibenzoyl polysulfide, dibenzothiazoyl polysulfide, dithiobenzoyl polysulfide and the like, and tetraalkylthiuram sulfide having the formula:

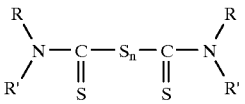

wherein n is an integer of 1 to 4, and R and R' represent $CH_3$, $C_2H_5$, $C_4H_9$, $C_6H_5$ or ethyleneoxy. These organic sulfide compounds may be used alone or in combination of two or more thereof. An amount of the organic sulfide compound is from 0.05 to 5 parts by weight, preferably from 0.1 to 2 parts by weight, based on 100 parts by weight of the base rubber. When the amount of the organic sulfide compound is smaller than 0.05 parts by weight, the technical effect of the organic sulfide compound does not sufficiently exhibit. On the other hand, when the amount of the organic sulfide compound is larger than 5 parts by weight, the technical effect is not further improved.

The rubber composition for the core of the present invention can further contain other components which have been conventionally used for preparing the core of solid golf balls, such as inert filler (such as zinc oxide, barium sulfate, calcium carbonate), antioxidant and the like.

The resulting core obtained by press-molding the rubber composition using the method and condition which have been conventionally used for preparing the core of solid golf balls preferably has a diameter of 32 to 37.5 mm. In order to obtain the desired shot feel, the core preferably has a deformation amount of 3.5 to 6.0 mm, when applying from an initial load of 10 kg to a final load of 130 kg on the core. When the deformation amount is smaller than 3.5 mm, the core is too hard. On the other hand, when the deformation amount is larger than 6.0 mm, the core is too soft.

Then, an inner cover 2 and an outer cover 3 are covered on the core 1. The inner cover material may be ionomer, polyester, nylon and the like. These inner cover materials may be used alone or in combination of two or more thereof. It is preferable that the inner cover material has a flexural modulus of 3,000 to 7,000 kgf/cm$^2$ and a thickness of 1.0 to 3.0 mm in view of shot feel and flight performance.

The outer cover material may be materials which have been conventionally used for forming the cover of solid golf balls, such as ionomer resin and the like. These outer cover materials may be used alone or in combination of two or more thereof. It is preferable that the outer cover material has a flexural modulus of 1,000 to 2,800 kgf/cm$^2$ and a thickness of 1.0 to 3.0 mm in view of shot feel and flight performance. It is preferable that total thickness of the inner cover and the outer cover is within the range of 2.0 to 5.0 mm.

The cover used in the present invention (the inner cover 2 and the outer cover 3) may optionally contain pigments (such as titanium dioxide, etc.), and the other additives such as a UV absorber, a photostabilizer and a fluorescent agent or a fluorescent brightener, etc., in addition to the cover material, as long as the addition of the additives does not deteriorate the desired performance of the golf ball cover.

The cover layer of the present invention is formed by a conventional method for forming golf ball cover well known in the art, such as injection molding, press molding and the like. The method comprises the steps of forming the inner cover 2 on the core 1 and forming the outer cover 3 on the inner cover 2. When forming the outer cover 3, many depressions called "dimples" are generally formed on the surface of the golf ball. Both the inner and outer cover layer preferably have a thickness of 1.0 to 2.3 mm. In the golf ball of the present invention, paint finishing may be provided on the surface after cover forming for serving commercial sell.

According to the present invention, a core which is soft and has good rebound characteristics is obtained by using an organic sulfide compound, thereby providing a golf ball having good shot feel and excellent flight performance.

EXAMPLES

The following Examples and Comparative Examples further illustrate the present invention in detail but are not to be construed to limit the scope thereof.

Formulation (a) Core composition

Each spherical core having a diameter of 35.6 mm was obtained by mixing the following core composition and press-molding the mixture.

TABLE 1

| | Example | | | | | Comparative Example | | |
|---|---|---|---|---|---|---|---|---|
| Kind | 1 | 2 | 3 | 4 | 5 | 1 | 2 | 3 |
| BR-01 *1 | 100 | 100 | 100 | 100 | 100 | 100 | 100 | — |
| Zinc acrylate | 26 | 28 | 26 | 26 | 26 | 26 | 24 | — |
| Zinc oxide | 30 | 29 | 30 | 30 | 30 | 30 | 31 | — |
| Dicumyl peroxide | 2.0 | 2.0 | 2.0 | 2.0 | 2.0 | 2.0 | 2.0 | — |
| Antioxidant *2 | 0.5 | 0.5 | 0.5 | 0.5 | 0.5 | 0.5 | 0.5 | — |
| Diphenyl disulfide | 0.5 | 2.0 | 0.5 | 0.5 | 0.5 | — | — | — |

Vulcanizing condition: 150° C. × 25 min.

(b) Inner cover composition

Each inner cover layer having a thickness of 1.7 mm was formed by injection molding the following cover composition on the core.

TABLE 2

| Kind | A | B | C | D |
|---|---|---|---|---|
| Hi-milan *3 1605 | — | 40 | 38 | — |
| Hi-milan 1706 | — | 40 | 38 | 50 |
| Hi-milan AM7317 | 40 | — | — | — |
| Hi-milan AM7318 | 60 | — | — | — |
| Rilsan ANN OD *4 | — | 20 | — | — |
| Hi-milan 1855 | — | — | 50 | — |
| IOTEC 8000 *5 | — | — | — | 50 |

*1: Polybutadiene (trade name "BR-01") from Japan Synthetic Rubber Co., Ltd.
*2: Antioxidant (trade name "Yoshinox 425") from Yoshitomi Pharmaceutical Inds., Ltd.
*3: Hi-milan (trade name), ionomer resin, manufactured by Mitsui Du Pont Polychemical Co., Ltd.
*4: Rilsan ANN OD (trade name), polyamide elastomer, manufactured by Toray Co., Ltd.
*5: IOTEC 8000 (trade name), ionomer resin, manufactured by Exxon Chemical Co.

TABLE 3

| Kind | E | F | G | H |
|---|---|---|---|---|
| Hi-milan 1652 | 50 | — | 25 | 30 |
| Hi-milan 1855 | 50 | — | 25 | 30 |
| Hi-milan 1557 | — | 50 | — | — |
| Hi-milan 1605 | — | 50 | — | — |
| Hi-milan 1706 | — | — | 25 | 20 |
| Hi-milan 1707 | — | — | 25 | 20 |

TABLE 4

| Example No. | 1 | 2 | 3 | 4 | 5 |
|---|---|---|---|---|---|
| Inner cover composition | A | B | A | C | D |
| Flexural modulus (kgf/cm$^2$) | 4400 | 5100 | 4400 | 3000 | 4200 |
| Outer cover composition | E | E | G | H | H |
| Flexural modulus (kgf/cm$^2$) | 1300 | 1300 | 2800 | 2600 | 2600 |
| W#1 Carry (yard) | 221 | 219 | 222 | 219 | 221 |
| Shot feel | ○ | ○ | ○ | ○ | ○ |
| Controllability at approach shot | ○ | ○ | ○ | ○ | ○ |

TABLE 5

| Comparative Example No. | 1 | 2 | 3(*1) |
|---|---|---|---|
| Inner cover composition | A | A | — |
| Flexural modulus ($kgf/cm^2$) | 4400 | 4400 | — |
| Outer cover composition | E | F | — |
| Flexural modulus ($kgf/cm^2$) | 1300 | 3100 | — |
| W#1 Carry (yard) | 217 | 216 | 220 |
| Shot feel | x | x | Δ |
| Controllability at approach shot | Δ | X | Δ |

*1: two-piece golf ball, manufactured by Sumitomo Rubber Industries., Ltd.

As is apparent from the comparison of the physical properties of the golf balls of Examples with those of the golf balls of Comparative Examples, the golf balls of Examples show a carry flight distance farther than the golf balls of Comparative Examples, and have better shot feel and better controllability at approach shot than the golf balls of Comparative Examples.

Test Method (a) Carry

The golf balls composed of the core, the inner cover layer and the outer cover layer comprising the compositions described above were produced. After a No. 1 wood club W#1 was mounted to a swing robot manufactured by True Temper Co. and the golf ball was hit at a head speed of 45 m/second, a carry was measured as a flight distance.

(b) Shot feel and controllability

The shot feel and controllability at approach shot of the golf ball were evaluated by 10 professional or high level amateur golfers according to a practical hitting test. The evaluation criteria are as follows.

(Evaluation criteria):

○: Not less than 8 out of 10 golfers felt that the golf ball has good shot feel or good controllability.

Δ: From 4 to 7 out of 10 golfers felt that the golf ball has good shot feel or good controllability.

x : Not more than 3 out of 10 golfers felt that the golf ball has good shot feel or good controllability.

EFFECT OF THE INVENTION

In the solid golf ball of the present invention, rebound characteristics can be restrained from degrading when reducing the core hardness, by using the core obtained by molding the compositions described above, and durability, shot feel at the time of hitting and controllability at approach shot can be improved by using multi-layer structured cover.

What is claimed is:

1. A solid golf ball comprising a core and a cover formed on the core, wherein the cover has a two-layer structure consisting of an inner cover and an outer cover formed on the inner cover, and the core is formed from a rubber composition comprising 0.05 to 5 parts by weight of an organic sulfide compound, based on 100 parts by weight of a base rubber, and the core has a deformation amount of 3.5 to 6.0 mm, when applying from an initial load of 10 kg to a final load of 130 kg on the core.

2. The solid golf ball according to claim 1, wherein the inner cover has a flexural modulus of 3,000 to 7,000 $kgf/cm^2$.

3. The solid golf ball according to claim 1, wherein the outer cover has a flexural modulus of 1,000 to 2,800 $kgf/cm^2$.

* * * * *

UNITED STATES PATENT AND TRADEMARK OFFICE

CERTIFICATE OF CORRECTION

PATENT NO. : 5,919,101

DATED : July 6, 1999

INVENTOR(S) : Yokota et al.

It is certified that error appears in the above-identified patent and that said Letters Patent is hereby corrected as shown below:

On the title page, "[30] Foreign Application Priority Data", please correct the two foreign application numbers as follows:

Change "6-217292" to -- 7-217292 --; and

Change "6-123209" to -- 8-123209 --.

Signed and Sealed this

Eighth Day of February, 2000

*Attest:*

*Attesting Officer*

Q. TODD DICKINSON

*Commissioner of Patents and Trademarks*